US005845462A

United States Patent [19]

Kuehl et al.

[11] Patent Number: 5,845,462

[45] Date of Patent: Dec. 8, 1998

[54] COUPON INSERTER

[75] Inventors: Craig M. Kuehl, Green Bay; Michael G. Boehm, DePere, both of Wis.

[73] Assignee: Northfield Corporation, De Pere, Wis.

[21] Appl. No.: 763,004

[22] Filed: Dec. 10, 1996

[51] Int. Cl.[6] ..... B65B 63/00

[52] U.S. Cl. ..... 53/435; 53/474; 53/55

[58] Field of Search ..... 225/4, 100, 106; 53/520, 474, 249, 435, 55, 505

[56] References Cited

U.S. PATENT DOCUMENTS

| | | |
|---|---|---|
| 2,513,093 | 6/1950 | Hagman . |
| 2,618,336 | 11/1952 | Davidson . |
| 2,655,842 | 10/1953 | Baumgartner . |
| 3,127,027 | 3/1964 | Roser et al. . |
| 3,128,928 | 4/1964 | Davis . |
| 3,140,026 | 7/1964 | Davis . |
| 3,146,927 | 9/1964 | Peterson . |
| 3,182,876 | 5/1965 | Sedor et al. . |
| 3,220,158 | 11/1965 | Roser et al. . |
| 3,272,044 | 9/1966 | Obenshain . |
| 3,281,143 | 10/1966 | Mommsen et al. . |
| 3,302,946 | 2/1967 | Anderson . |
| 3,332,324 | 7/1967 | Lehmacher et al. . |
| 3,388,487 | 6/1968 | Schutz . |
| 3,390,875 | 7/1968 | Beert et al. . |
| 3,481,520 | 12/1969 | Pickering . |
| 3,631,651 | 1/1972 | Kopp . |
| 3,659,766 | 5/1972 | Alago . |
| 3,672,551 | 6/1972 | Peterson . |
| 3,730,411 | 5/1973 | Brockmuller . |
| 3,741,451 | 6/1973 | Parenti et al. . |
| 3,748,937 | 7/1973 | Long . |
| 3,777,958 | 12/1973 | Graham . |
| 3,794,228 | 2/1974 | Colwill et al. . |
| 3,797,822 | 3/1974 | Anderson . |
| 3,847,318 | 11/1974 | Parenti et al. . |
| 3,856,196 | 12/1974 | Bayne . |
| 3,863,821 | 2/1975 | Van Bennekom . |
| 3,881,645 | 5/1975 | Kopp . |
| 3,888,399 | 6/1975 | Hanson et al. . |
| 3,897,052 | 7/1975 | Turman et al. . |
| 3,908,983 | 9/1975 | Long . |
| 3,929,326 | 12/1975 | Seragnoli . |
| 3,968,196 | 7/1976 | Wiley . |
| 3,987,603 | 10/1976 | Jelling et al. ..... 225/4 |
| 3,991,924 | 11/1976 | Schueler . |
| 4,022,364 | 5/1977 | Davis . |

(List continued on next page.)

FOREIGN PATENT DOCUMENTS

| | | |
|---|---|---|
| 2013280 | 11/1990 | Canada . |
| 0472624 | 3/1992 | European Pat. Off. . |
| 53-31067 | 8/1978 | Japan . |
| 53-38997 | 10/1978 | Japan . |

OTHER PUBLICATIONS

Longford Equipment International Limited Product Brochures and Advertisements Apr. 1984.

*Primary Examiner*—James F. Coan
*Assistant Examiner*—Gene L. Kim
*Attorney, Agent, or Firm*—Godfrey & Kahn, S.C.; Brian G. Gilpin

[57] ABSTRACT

A coupon inserter assembly receives a continuous supply of coupons in the form of a web where the forwardmost coupon is attached to the following coupon along a weakened web portion. The inserter assembly includes a pair of intermittently rotating feed rollers and a pair of continuously rotating delivery rollers. An activation sensor is located at a dispensing location or a conveyor carrying receiving products for receiving coupons. When the activation sensor senses a receiving product, a signal is sent to a clutch-brake to activate the feed rollers. The feed rollers then feed the web into the delivery rollers. When a deactivation sensor located beyond the delivery rollers senses the presence of the forwardmost coupon, a signal is sent to the clutch-brake which stops the rotation of the feed rollers. Because the delivery rollers continue to pull the forwardmost coupon, the two coupons separate along the weakened web portion. The forwardmost coupon can then be delivered to the dispensing location for placement in or on the receiving product.

25 Claims, 4 Drawing Sheets

U.S. PATENT DOCUMENTS 4,025,023 5/1977 Moffitt .
4,039,181 8/1977 Prewer .
4,060,168 11/1977 Romagnoli .
4,069,957 1/1978 Moffitt .
4,091,978 5/1978 Graham, II .
4,118,022 10/1978 Rayfield et al. .
4,131,272 12/1978 Hartnig .
4,145,035 3/1979 Moser .
4,179,113 12/1979 Gallimore ..... 271/12
4,182,222 1/1980 Stahl .
4,216,952 8/1980 McInerny .
4,217,744 8/1980 Mizutani .
4,222,511 9/1980 Schueler .
4,261,497 4/1981 Roetter et al. ..... 225/106
4,268,344 5/1981 Jones ..... 53/553
4,284,221 8/1981 Nagel et al. .
4,323,230 4/1982 Rising .
4,345,753 8/1982 Marshall .
4,351,517 9/1982 Neal et al. .
4,354,894 10/1982 Lewis et al. ..... 156/517
4,375,189 3/1983 Berner et al. .
4,385,537 5/1983 Wolf .
4,397,410 8/1983 Schueler .
4,401,249 8/1983 Kadlecik et al. .
4,412,631 11/1983 Haker .
4,429,217 1/1984 Hill et al. .
4,454,973 6/1984 Irvine .
4,455,809 6/1984 Dllaserra .
4,473,218 9/1984 Dudek .
4,479,597 10/1984 Johnson et al. .
4,498,894 2/1985 Kuckhermann .
4,516,765 5/1985 Stocco et al. .
4,524,557 6/1985 Silverman et al. .
4,529,114 7/1985 Casper et al. .
4,530,200 7/1985 Prewer ..... 53/157
4,606,534 8/1986 Gombault .
4,616,773 10/1986 Kerivan .
4,623,081 11/1986 Hain et al. .
4,651,983 3/1987 Long .
4,658,564 4/1987 Bell, Jr. et al. .
4,668,212 5/1987 Kotani .
4,688,708 8/1987 Irvine et al. ..... 225/106
4,696,145 9/1987 Schmidt et al. .
4,717,043 1/1988 Groover et al. .
4,929,226 5/1990 Focke et al. .
4,982,337 1/1991 Burr et al. .
5,079,901 1/1992 Kotsiopoulos ..... 53/435
5,297,711 3/1994 Kogen ..... 225/100
5,427,294 6/1995 Vander Menvel et al. ..... 225/100
5,549,233 8/1996 Clauser ..... 225/100
5,588,280 12/1996 Kotsiopoulos .

10
20
21
35
25
25
26
28
42
28
29
29
52
71
70
90
92
91
85
55
87
27
75
62
61
80
65
95
100
99

COUPON INSERTER

FIELD OF THE INVENTION

This invention relates generally to an apparatus for inserting coupons into containers or placing coupons onto goods, and in particular to a coupon inserter apparatus that can place coupons of various sizes and burst forces from a continuous web into containers or onto goods that are moving along a high volume handling system at a variable rate.

BACKGROUND OF THE INVENTION

It is a common advertising and promotional technique to place coupons, discount cards, prizes or other promotional materials into containers such as cartons for breakfast cereal or snack items or on top of plastic-wrapped products such as cheese slices. The coupon is highly visible to the consumer who can then use the coupon for the intended purpose, such as for discounts on future purchases or rebates. Accordingly, the term "coupon" used herein includes any type of insert, coupon, card, sheet, receipt, warranty, premium, or other part that can be advantageously handled in accordance with the invention hereinafter described. Similarly, the terms "container" and "receiving product" are used in the broadest possible context to include containers such as boxes, tubs, cans, and vessels of all kinds as well as other coupon receiving objects that can be advantageously used with the present invention.

Typically, coupon inserting devices operate by discharging or positioning a single coupon in each container rapidly moving along a conveyor system or other similar product handling system. There are several methods and apparatus for placing a single coupon into the container. One requires a stack of pre-cut coupons that are individually dispensed from a downwardly sloping channel, such as the system shown in Prewer, U.S. Pat. No. 4,530,200. In that system, pusher elements and advancing rollers coact to withdraw the forwardmost coupon from the pre-cut stack. The coupon is then drawn into the downwardly sloping channel to a dispensing location. In another apparatus, shown in Gallimore, U.S. Pat. No. 4,197,113, a reciprocal vacuum head picks a coupon from a stack of pre-cut coupons and places the coupon on a conveyor system, which in turn transports the coupons to the containers. Another system, shown in Lewis et al., U.S. Pat. No. 4,354,894, requires the use of a mechanical cutting device to separate each coupon from a continuous web. Once separated, the coupons are dispensed to the containers using a conveyor system. Yet another system, shown in Kotsiopoulos, U.S. Pat. No. 5,079,901, separates a single coupon from a continuous web of coupons using a bursting technique and injects the coupon into the container.

There are several limitations and disadvantages to the above described systems. First, the systems using pre-cut coupons are highly susceptible to jamming when operated at a high rate of speed, and many of the pre-cut systems are not easily adaptable to a variety of coupon and container configurations. Second, many of the pre-cut insertion machines and the mechanical cutting machines are simply incapable of reliably processing coupons at high insertion rates. Third, existing burster-type machines are expensive to purchase and maintain because they generally require the use of multiple stepper-motors for bursting the coupons. Finally, existing burster-type machines cannot provide the bursting force necessary to separate many types of perforated coupons.

This invention relates to improvements to the systems described above and to solutions to some of the problems raised or not solved thereby.

SUMMARY OF THE INVENTION

It is therefore an object of the present invention to provide a burster-type coupon insertion machine that uses only one conventional motor, thus reducing purchase and maintenance costs.

It is another object of the present invention to provide a coupon insertion machine that can adapt to changes in the speed of the conveyor transporting the containers.

It is a further object of the present invention to provide a coupon insertion machine capable of reliably operating at high speeds.

It is still another object of the present invention to provide a coupon insertion machine capable of separating a variety of coupon sizes, shapes, and burst strengths.

It is yet another object of the present invention to provide a coupon insertion machine with an integrated coupon delivery mechanism.

These and other objects and advantages of the present invention will become apparent from the detailed description, claims, and accompanying drawings.

The coupon inserter of the present invention provides the above identified and many additional objects through an apparatus that separates the forwardmost coupon from a continuous web of separable coupons and delivers the coupon into a container or lays the coupon onto goods passing by a coupon dispensing location. The present invention further provides a method for using the same apparatus that bursts the coupons from the continuous web to achieve the ultimately desired result—placing the coupons into containers or onto goods.

The preferred embodiment of the coupon inserter in accordance with the present invention has a frame to which a motor, feed rollers, delivery rollers, a power transmission including a clutch and brake, an activation sensor, and a deactivation sensor are connected. The frame may be attached to a mounting bracket to position the coupon inserter's dispensing location in the appropriate place along a conveyor or other product handling system. The motor and power transmission are connected to a control unit which controls the speed and timing of the coupon inserter. The activation sensor is linked to the power transmission to provide an activation signal when a receiving product is approaching the coupon dispensing location. When the coupon inserter apparatus is turned on, the motor continually rotates the delivery rollers and the input side of the power transmission. The power transmission begins rotation of the feed rollers in response to a signal from the activation sensor, and terminates rotation of the feed rollers in response to a signal from the deactivation sensor. The feed rollers and the delivery rollers rotate at substantially the same speed when the feed rollers are rotating.

In use, the coupon inserter is placed in proximity to a conveyor belt or other product handling system which moves containers into which coupons must be inserted. The activation sensor for sensing the presence of a container approaching the dispensing location is placed in working proximity to the conveyor. A continuous web of coupons is fed into the nip between the feed rollers, then the coupon inserter apparatus is turned on starting, the electric motor. The motor drives a power transmission which continually drives the delivery rollers. Thus, the delivery rollers continually rotate so long as the system is powered. When the activation sensor detects the presence of a container approaching the dispensing location, the power transmission is signaled to engage, which begins rotation of the feed rollers, causing the coupon web to be directed toward the nip between the delivery rollers. After passing through the delivery rollers, the leading edge of the forwardmost coupon passes the deactivation sensor, which signals the power transmission to stop the rotation of the feed rollers. The deactivation sensor is adjustable and is positioned such that the feed rollers stop rotating while the weakened web portion between two individual coupons in the continuous coupon web is located between the nip of the feed rollers and the nip of the delivery rollers. Because the delivery rollers are still directing the coupon web toward the dispensing location when the feed rollers stop rotating, the forwardmost coupon separates from the coupon web at the weakened portion. The now-separated coupon travels to the dispensing location and, depending on the speed of the motor, is delivered into the container or lays onto the goods as desired. The process then repeats for the next container or receiving product.

DETAILED DESCRIPTION

Figure 1:
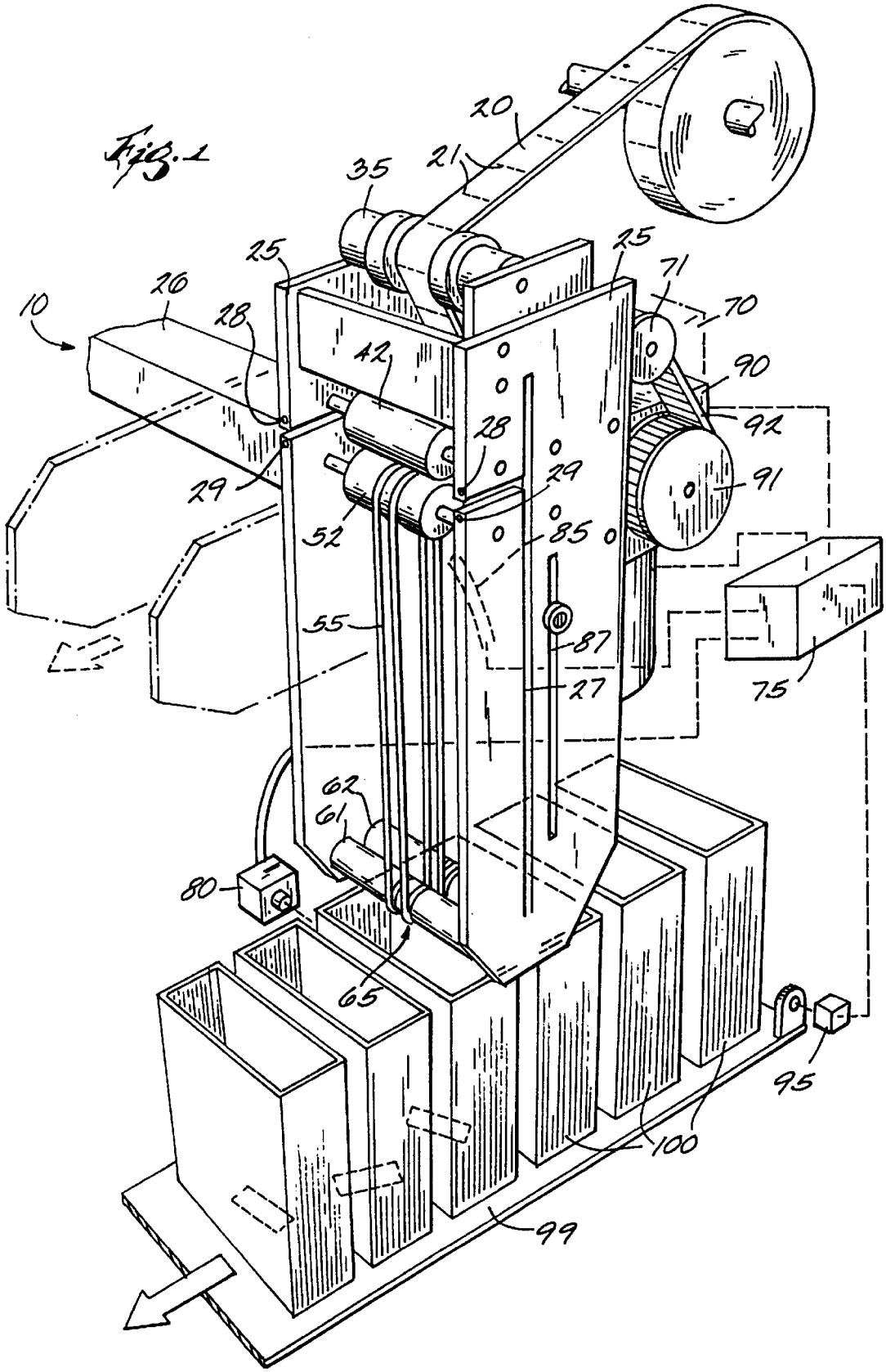
FIG. 1 is a perspective view, partially schematic, of a coupon inserter apparatus constructed in accordance with one embodiment of the present invention.

FIG. 1 shows a perspective view of a coupon inserter apparatus 10, constructed in accordance with one embodiment of the present invention. The apparatus 10 is shown oriented above a conveyor 99 which carries receiving product 100 toward a dispensing location 65. The purpose of the apparatus 10 is to separate the forwardmost coupon 22 from a continuous web 20 of separable coupons along a weakened web portion 21 and place the forwardmost coupon 22 in or on a receiving product 100. The receiving product 100 may be a wide variety of containers such as cereal, rice, or cracker boxes, or may be an individual product or stack of products onto which a coupon is desired to be placed such as a stack of cheese slices. The continuous web 20 may be attached in roll form to the frame 25 of the apparatus 10, or may be separate.

The apparatus 10 includes a frame 25 which may be mounted using mounting bracket 26 to a conveyor system 99 or other similar product handling system. As more clearly shown in FIGS. 2 and 3, the continuous web 20 enters the apparatus over a set of intake rollers 35, which are guide rollers or idlers to guide the web into the feed rollers 40, free to rotate. The intake rollers 35 direct the web 20 into the feed rollers nip 44 formed between the feed rollers 40, which individually are outer feed roller 42 and inner feed roller 43. When feed rollers 40 rotate, the web 20 is fed into the nip between delivery rollers 50, which individually are outer delivery roller 52 and inner delivery roller 53. The delivery rollers 50 advance the web 20 toward the dispensing location 65. When the leading edge of the forwardmost coupon 22 of the web 20 reaches deactivation sensor 85, the feed rollers 40 stop rotating, while continuing to grip the following coupon 23. Because the forwardmost coupon 22 continues to be advanced toward the dispensing location 65 by the delivery rollers 50, the forwardmost coupon 22 separates from the following coupon 23 at the weakened web point 21. In the embodiment shown, the now separated forwardmost coupon 22 is directed toward the dispensing rollers 60, which include outer dispensing roller 61 and inner dispensing roller 62, at the dispensing location 65, by coupon conveying belts 55 reeved upon the dispensing rollers 60 and the delivery rollers 50. In this embodiment the forwardmost coupon 22 exits the apparatus between the dispensing rollers 60 and, depending on the speed of motor 90, is dropped into or placed upon the receiving product 100.

Figure 3:
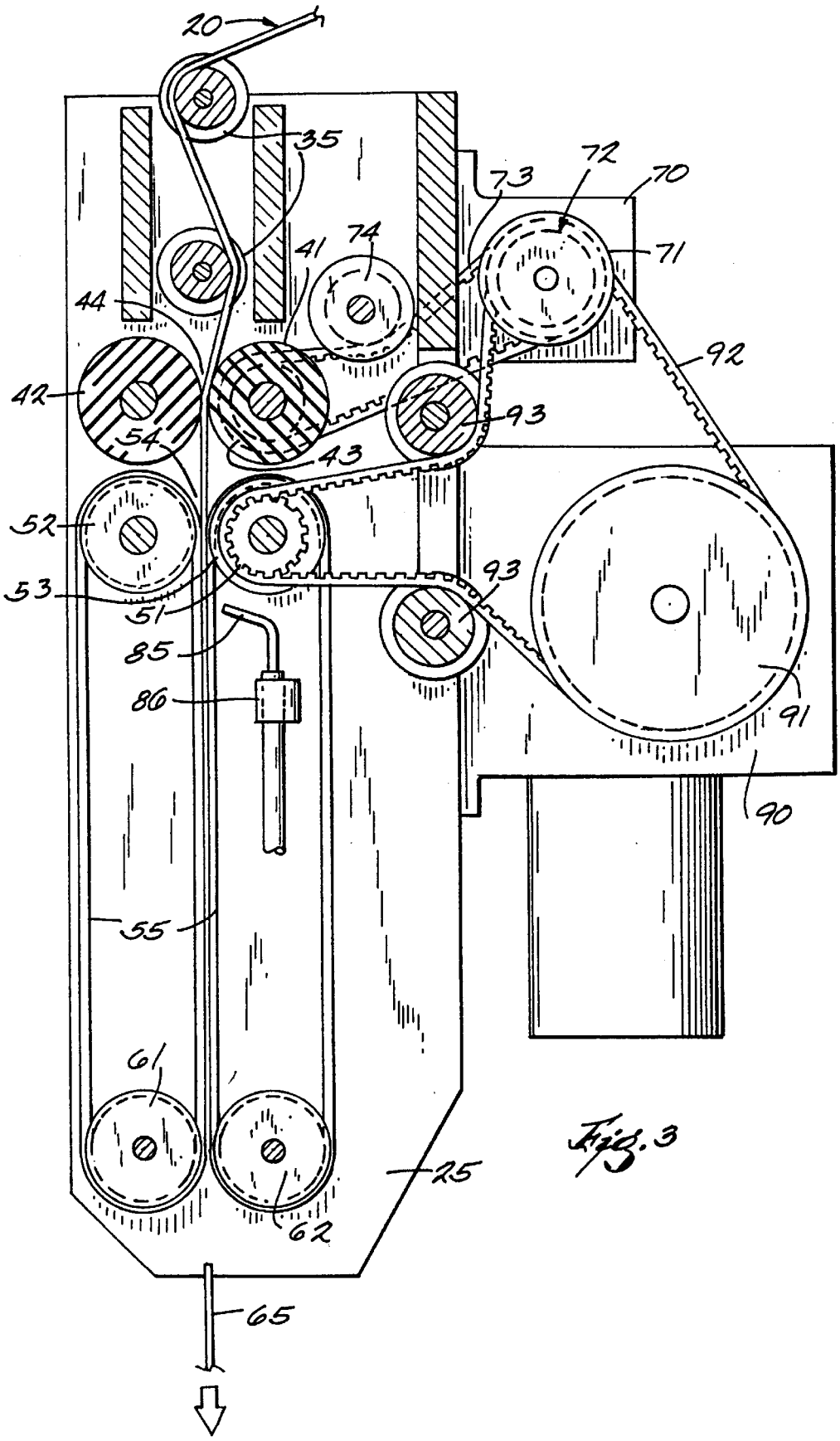
FIG. 3 is a cross-sectional view of the embodiment of the coupon inserter apparatus shown in FIG. 2, with portions removed for clarity.

FIG. 3 shows a preferred mechanism for powering the coupon inserter apparatus 10. A motor 90 rotates feed rollers 40, delivery rollers 50, and dispensing rollers 60 through a power transmission or roller drive 30, which in the embodiment shown is system of belts, pulleys, belt tensioning rollers, nips, and conveying belts. The belts are described as toothed belts, and the pulleys as toothed wheels, because such toothed components can improve the accuracy, and reduce the distortion, with which the rollers are rotated, although there are envisioned, of course, other structures which can provide similar functionality. Motor 90 may be a 90 volt DC motor, such as those available from Leeson, or an equivalent motor. Attached to motor 90, preferably through a speed reducer 94, is motor toothed wheel 91 which, when the apparatus is powered, is continually rotating. Reeved about wheel 91 is motor toothed belt 92. After passing over motor belt tensioning idler rollers 93, belt 92 travels around clutch-brake drive input toothed wheel 71 and inner delivery roller toothed wheel 51 (part of or attached to inner delivery roller 53) causing wheel 71 and wheel 51 to continually rotate. Outer delivery roller 52 is caused to continually rotate by the friction between it and inner delivery roller 53 at delivery rollers nip 54. Dispensing rollers 60 are rotatably connected to delivery rollers 50 by a plurality of coupon conveying belts 55. Thus, dispensing rollers 60 continually rotate at the same speed as the delivery rollers 50. Clutch-brake 70 transmits the rotational drive force from clutch-brake drive input toothed wheel 71 to clutch-brake output toothed wheel 72 based on signals originating from activation sensor 80 and deactivation sensor 85. Clutch-brake 70 may be a model number EP-170 made by Warner Electric or an equivalent clutch-brake. When the clutch-brake 70 is engaged in clutch mode, rotational drive force is transmitted to clutch-brake drive output toothed wheel 72. This in turn causes clutch-brake toothed belt 73, guided by clutch-brake belt positioning roller 74, to move, causing inner feed roller toothed wheel 41 (part of or attached to inner feed roller 43) to rotate. Outer feed roller 42 is caused to rotate by the friction between it and inner feed roller 43 at feed rollers nip 44. Thus clutch-brake 70 transmits rotational drive force from motor 90 to feed rollers 40.

While the preferred embodiment uses only one conventional motor 90 to rotate the rollers, it is possible that a stepper motor or multiple motors could be used. Of course, if multiple motors or a stepper motor are used, appropriate feed drive configurations must be designed. For cost and simplicity, the single conventional motor 90 is preferred.

As shown in FIG. 1, activation sensor 80, connected to clutch-brake 70 by means of a controller 75, is placed in a location proximate to the receiving product 100 traveling down conveyor 99. The activation sensor 80 is placed in a position along the length of conveyor 99 such that the time it takes for 1) the activation sensor 80 to sense the presence of receiving product 100, 2) signal clutch-brake 70 to begin rotating clutch-brake drive output wheel 72, and 3) the forwardmost coupon 22 to travel to the dispensing location 65, is the same time that it takes the receiving product 100 to be carried to the dispensing location 65 by the conveyor. Thus, the forwardmost coupon 22 and the receiving product 100 meet at the dispensing location 65 at the appropriate time. Activation sensor 80 may be a mini-beam SM312D sensor from Banner or an equivalent sensor.

Figure 2:
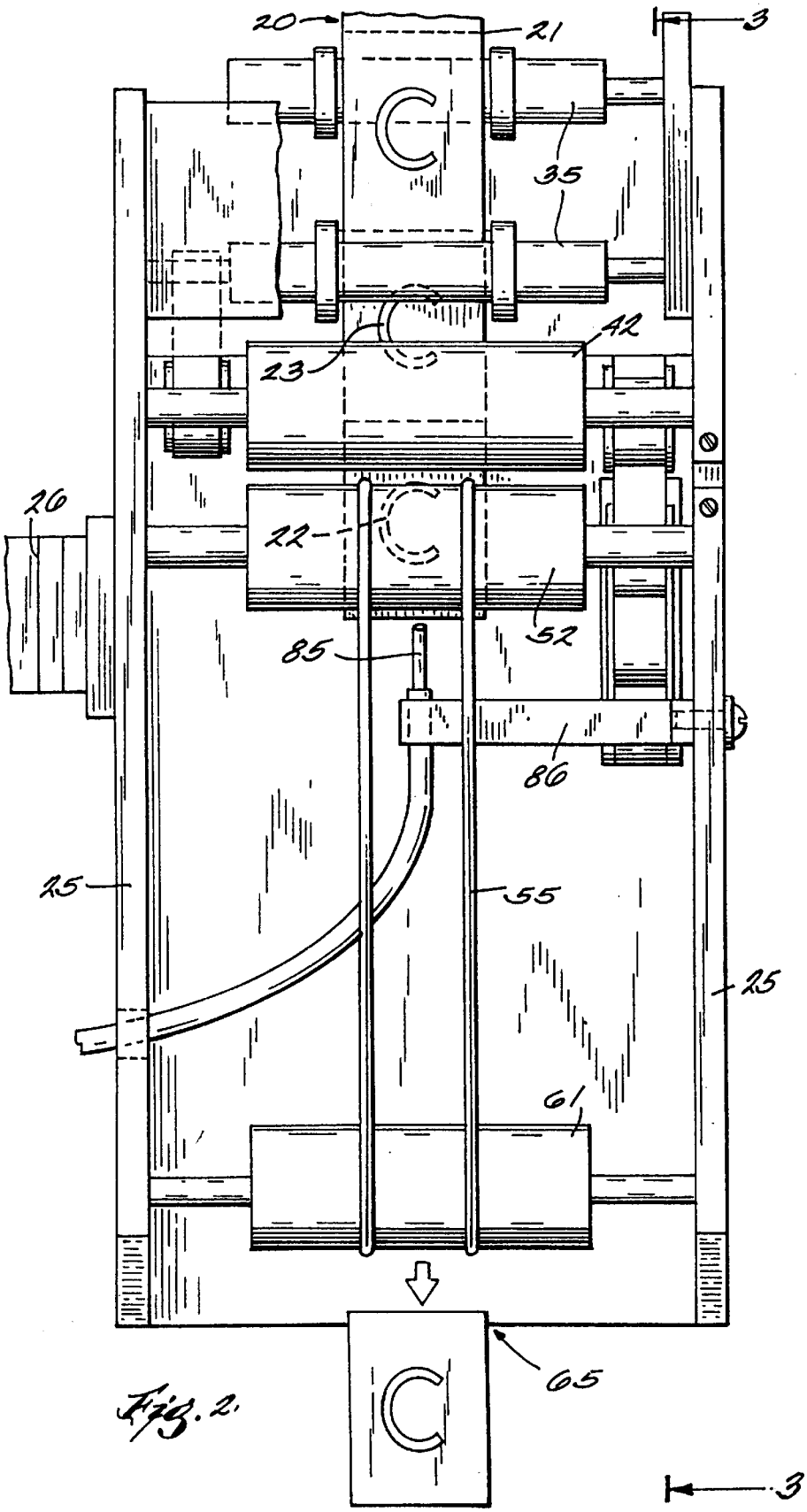
FIG. 2 is a bottom plan view of the coupon inserter apparatus shown in FIG. 1, with part of the apparatus removed to show the path of the continuous web of coupons.
Figure 4:
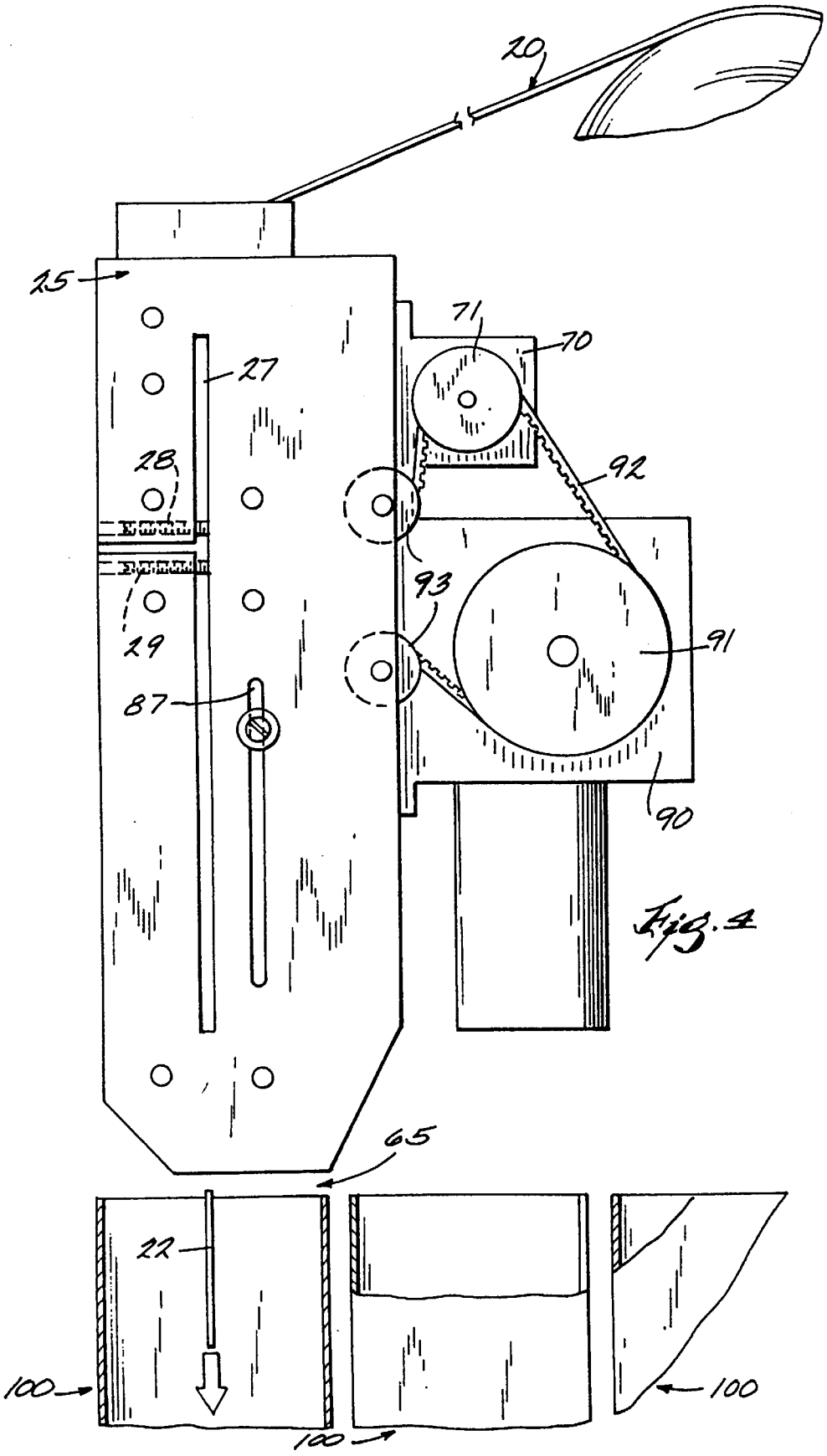
FIG. 4 is a side plan view of the coupon inserter apparatus in accordance with the present invention.

As shown in FIGS. 1, 2, and 4, deactivation sensor 85 is adjustably mounted to frame 25 on a sensor mounting bracket 86 adjustably fixed in place in sensor adjusting slot 87. When deactivation sensor 85 senses the presence of the leading edge of forwardmost coupon 22, it signals clutch-brake 70, via controller 75, to brake output wheel 72. The position of deactivation sensor 85 is adjusted such that when the leading edge of the forwardmost coupon 22 is sensed, the weakened web point 21 between forwardmost coupon 22 and following coupon 23 is located between the feed rollers nip 44 and the delivery rollers nip 54. Thus, because delivery rollers 50 continue pulling forwardmost coupon 22 toward the dispensing location 65 after feed rollers 40 stop rotating, forwardmost coupon 22 separates from following coupon 23 at the weakened web portion 21. Deactivation sensor 85 may be a SM312FV sensor manufactured by Banner or an equivalent sensor.

As shown in FIGS. 1 and 4, feed rollers 40 are rotatably mounted to frame 25 such that inner feed roller 43 and outer feed roller 42 are mounted to spaced apart but facing portions of the frame on opposite sides of flex-slot 27. A first set of adjustable set screws 28 are provided, each passing through one arm of the frame and threaded into the other arm. Thus, by tightening or loosening either or both of the set screws 28, the distance between the centers of inner feed roller 43 and outer feed roller 42 at feed rollers nip 44 can be adjusted to accommodate a variety of coupon thicknesses or to compensate for worn feed rollers 40. In a similar manner, delivery rollers 50 are rotatably mounted to spaced apart but facing portions of frame 25 such that inner delivery roller 53 and outer delivery roller 52 are mounted on opposite sides of flex-slot 27, and a second set of adjustable set screws 29 are provided, spanning the flex-slot. By tightening or loosening the set screws 29, the distance between the centers of inner delivery roller 53 and outer delivery roller 52 at delivery rollers nip point 54 can be adjusted to accommodate a variety of coupon thicknesses or to compensate for worn delivery rollers 50. Feed rollers 40 and delivery rollers 50 are covered with a compressible and high friction material, such as a pliable rubber, to allow the rollers to adequately grip the coupons.

The coupon conveying belts 55, shown in FIGS. 1–3, may be made from some flexible but relatively high friction material, including rubber, plastic, or some combination thereof, such as belts supplied by Eagle Belting. Belts 55 may be in guide grooves in the delivery rollers 50 and dispensing rollers 60. In particular, one set of the coupon conveying belts 55 reeved about the inner delivery roller 53 are also reeved about the inner dispensing roller 62, while a second set of the coupon conveying belts 55 reeved about the outer delivery roller 52 are also reeved about the outer dispensing roller 61. In this way, multiple coupon conveying belts 55 may be used to convey the separated forwardmost coupon 22 to the dispensing location 65.

In operation, the coupon inserter apparatus 10 is placed in proximity to the conveyor 99 which moves the receiving product 100 toward the dispensing location 65. The activation sensor 80 is placed near the conveyor 99 such that, at the time that the receiving product 100 is present in front of the activation sensor, the activation sensor triggers the coupon inserter apparatus 10 to deliver a coupon to the dispensing location 65. The proper location for the activation sensor 80 may be found through trial and error and, depending upon the particular application, by adjusting the speeds of the conveyor 99 and the motor 90. The deactivation sensor 85 is adjusted by moving the sensor mounting bracket 86 in the sensor adjusting slot 87 such that, when the deactivation sensor 85 senses the leading edge of the forwardmost coupon 22, the weakened web point 21 is positioned between the feed roller nip 44 and the delivery roller nip 54. The continuous web 20 of separable coupons is fed into the feed roller nip 44 between the inner feed roller 43 and the outer feed roller 42. Once the apparatus is set up in that way, the motor 90 is activated. The motor 90 drives the motor wheel 91 with the motor toothed belt 92 attached which, in return, continually turns the delivery rollers 50 through the inner delivery roller wheel 51 and the clutch-brake drive input wheel 71. When the activation sensor 80 senses the presence of a receiving product 100 approaching the dispensing location 65, it signals the clutch-brake 70 to allow the clutch-brake drive output wheel 72 to rotate which, through the clutch-brake toothed belt 73, rotates the feed rollers 40. This causes the web 20 to be directed toward the delivery roller nip 54. After passing through the delivery roller nip 54, the leading edge of the forwardmost coupon 22 reaches the deactivation sensor 85. The deactivation sensor 85 signals the controller to have the clutch-brake 70 brake the drive output wheel 72. Because the delivery rollers 50 are still pulling the forwardmost coupon 22 toward the dispensing location 65 and the feed rollers 40 are gripping the following coupon 23, the coupons separate at the weakened web point 21. The now separated forwardmost coupon 22 travels along the coupon conveying belts 55 between the dispensing rollers 60 and into or onto the receiving product 100 at the dispensing location 65. The process then repeats for the next receiving product 100.

In one embodiment of the present invention, shown in FIG. 1, the speed at which the motor 90 turns is continually adjusted to reflect changes in, or even match, the speed at which the receiving product 100 is approaching the dispensing location 65. This function would be advantageous in instances where the coupon must be placed upon the top of a solid block type of receiving product such as a stack of cheese slices, rather than inserted into a receiving product that is a container. This embodiment calls for placing a rolling sensor 95, known in the industry as an encoder, on the conveyor 99. The rolling sensor is capable, via controller 75, of signaling the motor 90 to adjust its speed to increase or decrease as the speed of the conveyor increases or decreases.

The coupon inserter apparatus 10 in accordance with the present invention is capable of operating at speeds from about zero coupons per minute up to about 600 coupons per minute depending on the size of the coupon and the demands of the conveyor conveying the receiving products. Smaller coupons would permit higher coupon per minute speeds. For example, in one commercial embodiment of the invention, two inch coupons can be run at up to about 600 coupons per minute, and the longest coupon which can be run is eight inch coupons, which can be run at a maximum of roughly 200 coupons per minute.

As illustrated by the foregoing description and shown in the Figures, the present invention is more suitable as a coupon inserter than existing systems. The present invention overcomes the limitations and disadvantages of existing coupon inserters by utilizing a cost effective design that only requires one motor and that can operate at a high or low rate of speed without jamming.

Although the invention has been herein shown and described in what is conceived to be the most practical and preferred embodiment, it is to be understood that the invention is not intended to be limited to the specific embodiments set forth above. Rather, it is recognized that modifications may be made by one of skill in the art of the invention without departing from the spirit or intent of the invention and therefore, the invention is to be taken as including all reasonable equivalents to the subject matter of the appended claims.

We claim:

1. An apparatus for delivering coupons to a dispensing location, said coupons being provided as a continuous web of successive coupons with a forwardmost coupon having a trailing edge connected by a weakened web portion to a leading edge of a following coupon, each successive coupon being similarly connected in the continuous web, said apparatus comprising:

feed rollers capable of engaging the continuous web of coupons in a nip between the feed rollers and capable of advancing the continuous web of coupons;

an activation sensor capable of sensing the presence of a receiving product approaching the dispensing location, said activation sensor activating rotation of the feed rollers;

delivery rollers capable of receiving the continuous web of coupons from the feed rollers in a nip formed by the delivery rollers and capable of advancing the forwardmost coupon toward the dispensing location, said delivery rollers being continually rotated, said delivery rollers being rotated at substantially the same rotational speed as said feed rollers when said feed rollers are rotating; and a deactivation sensor capable of sensing the presence of the forwardmost coupon at a sensing position downstream from the delivery rollers, said deactivation sensor deactivating rotation of the feed rollers immediately upon sensing the presence of the forwardmost coupon which results in separation of the forwardmost coupon from the following coupon along the weakened web portion.

2. The apparatus for delivering coupons to a dispensing location as in claim 1, further comprising a single drive means capable of rotating both the feed rollers and the delivery rollers.

3. The apparatus for delivering coupons to a dispensing location as in claim 2, wherein said deactivation sensor is adjustable to accommodate coupons of differing lengths.

4. The apparatus for delivering coupons to a dispensing location as in claim 3, wherein said deactivation sensor is positioned such that the feed rollers stop rotating while the weakened web portion of the continuous web of successive coupons is located between the nip between the delivery rollers and the nip between the feed rollers.

5. The apparatus for delivering coupons to a dispensing location as in claim 2, wherein the rotation of the feed rollers is activated and deactivated by an integrated clutch-brake.

6. The apparatus for delivering coupons to a dispensing location as in claim 2, further comprising delivery means for delivering the forwardmost coupon from the delivery rollers to the dispensing location.

7. The apparatus for delivering coupons to a dispensing location as in claim 6, wherein the delivery means for delivering the coupons to the dispensing location comprises dispensing rollers rotatably connected to the delivery rollers by a coupon conveying means.

8. The apparatus for delivering coupons to a dispensing location as in claim 6, wherein said coupon conveying means comprises a plurality of coupon conveying belts.

9. The apparatus for delivering coupons to a dispensing location as in claim 2, wherein the rotation speed of the delivery rollers and the speed of the delivery means are adjusted by a speed adjusting means to reflect changes in the speed at which the receiving product is approaching the dispensing location.

10. The apparatus for delivering coupons to a dispensing location as in claim 9, wherein said speed adjusting means comprises a rolling sensor in rolling engagement with a conveyor belt transporting the receiving product toward the dispensing location.

11. The apparatus for delivering coupons to the dispensing location as in claim 1, wherein the feed rollers and the delivery rollers are mounted on a flex-frame, said frame having a first set of adjustable set-screws capable of adjusting the tightness of the nip between the feed rollers and a second set of adjustable set-screws capable of adjusting the tightness of the nip between the delivery rollers.

12. An apparatus for delivering coupons to a receiving product at a dispensing location, said coupons being provided in the form of a continuous web of coupons with a forwardmost coupon having a trailing edge connected by a weakened portion to a leading edge of a succeeding coupon, each succeeding coupon being similarly connected in said web, said apparatus comprising:

a frame;

feed rollers rotatably mounted to the frame and forming a nip capable of engaging the continuous web of coupons;

a feed roller drive connected to the feed rollers and capable of activating said feed rollers to rotate and deactivating said feed rollers from rotating;

an activation sensor capable of sensing the presence of the receiving product approaching the dispensing location and thereupon sending a signal to activate the feed roller drive causing the feed rollers to rotate;

delivery rollers rotatably mounted to the frame, spaced apart from the feed rollers and forming a nip positioned to receive the continuous web of coupons from the feed rollers, said delivery rollers being continuously rotated at substantially the same rotational speed as said feed rollers when sad feed rollers are rotating; and a deactivation sensor positioned at a sensing position downstream from the delivery rollers and capable of sensing the presence of a coupon and immediately thereupon sending a signal to deactivate the feed roller drive and in turn the feed rollers, resulting in the separation of the forwardmost coupon from the succeeding coupon generally along the weakened web portion.

13. An apparatus as recited in claim 12 wherein said feed roller drive also continuously drives the delivery rollers.

14. An apparatus as recited in claim 13 wherein the feed roller drive includes a clutch and a brake for activating and deactivating the rotation of the feed rollers.

15. An apparatus as recited in claim 14 wherein, when the feed rollers are rotating, the feed rollers and the delivery rollers rotate at substantially the same speed.

16. An apparatus as recited in claim 12 wherein said deactivation sensor is adjustable to accommodate different coupon lengths.

17. An apparatus as recited in claim 16 wherein said deactivation sensor is positioned such that the feed rollers stop rotating while the weakened web portion of the continuous web of successive coupons is located between the nip between the delivery rollers and the nip between the feed rollers.

18. An apparatus as recited in claim 16 wherein the deactivation sensor is adjustably mounted to the frame and spaced beyond the delivery rollers, and the spacing between the deactivation sensor and the delivery rollers determines a range of lengths of coupon which can be used in the apparatus.

19. An apparatus as recited in claim 12 further comprising dispensing rollers rotatably connected to the delivery rollers by a coupon conveyor, delivering the coupons to the dispensing location.

20. An apparatus as recited in claim 19 wherein said coupon conveyor comprises a plurality of coupon conveying belts.

21. An apparatus as recited in claim 12 wherein the speed of rotation of the delivery rollers is adjusted by a speed control to reflect changes in the speed at which the receiving product approaches the dispensing location.

22. An apparatus as recited in claim 21 wherein the speed control comprises a rolling sensor in rolling engagement with a conveyor belt transporting the receiving product toward the dispensing location.

23. An apparatus as recited in claim 12 further comprising a first set of adjustable set screws capable of adjusting pressure at the nip of the feed rollers and a second set of adjustable set screws capable of adjusting pressure at the nip of the delivery rollers.

24. An apparatus for delivering coupons, one at a time, to moving receiving products as said receiving products move past a dispensing location, said coupons being provided in a continuous web wherein a trailing edge of a forwardmost coupon is detachably connected to a leading edge of a successive coupon by a weakened separable portion disposed therebetween, each coupon following said successive coupon being similarly connected in said-web, said apparatus comprising:

opposed delivery rollers rotatably mounted and defining a nip for receiving the leading edge of said forwardmost coupon;

opposed feed rollers disposed upstream from said delivery rollers, said feed rollers rotatably mounted and oriented for directing the leading edge of said forwardmost coupon into said nip of said delivery rollers;

a delivery drive mechanism coupled to at least one of said delivery rollers for driving said delivery rollers and moving said forwardmost coupon at a first speed;

a feed drive mechanism coupled to at least one of said feed rollers for driving said feed rollers and moving the leading edge of said forwardmost coupon toward said nip of said delivery rollers at a speed substantially the same as said first speed, said feed drive mechanism operating in response to an activation signal and ceasing operation in response to a deactivation signal, whereby said delivery rollers, upon the ceasing of operation of said feed drive mechanism, separate the trailing edge of said forwardmost coupon from the leading edge of said successive coupon and deliver the separated forwardmost coupon to said dispensing location;

a deactivation sensor disposed downstream from said delivery rollers for detecting the presence of the leading edge of said forwardmost coupon;

an activation sensor for detecting the movement of said receiving products; and a controller for providing said activation signal after said activation sensor senses the movement of said receiving products and for providing said deactivation signal after said deactivation sensor senses the presence of the leading edge of said forwardmost coupon.

25. An apparatus for delivering coupons, one at a time, to a dispensing location, said coupons being provided in a continuous web wherein a trailing edge of a forwardmost coupon is detachably connected to a leading edge of a successive coupon by a weakened separable portion disposed therebetween, each coupon following said successive coupon being similarly connected in said web, said apparatus comprising:

opposed delivery rollers rotatably mounted and defining a nip for receiving the leading edge of said forwardmost coupon;

opposed feed rollers disposed upstream from said delivery rollers, said feed rollers rotatably mounted and oriented for directing the leading edge of said forwardmost coupon into said nip of said delivery rollers;

a delivery drive mechanism coupled to at least one of said delivery rollers for driving said delivery rollers and moving said forwardmost coupon at a first speed;

a feed drive mechanism coupled to at least one of said feed rollers for driving said feed rollers and moving the leading edge of said forwardmost coupon toward said nip of said delivery rollers at a speed substantially the same as said first speed, said feed drive mechanism operating in response to an activation signal and ceasing operation in response to a deactivation signal, whereby said delivery rollers, upon the ceasing of operation of said feed drive mechanism, separate the trailing edge of said forwardmost coupon from the leading edge of said successive coupon and deliver the separated forwardmost coupon to said dispensing location;

a deactivation sensor disposed downstream from said delivery rollers for detecting the presence of the leading edge of said forwardmost coupon;

an activation sensor for detecting a demand for a coupon at said dispensing location; and a controller for providing said activation signal after said activation sensor senses the demand for a coupon at said dispensing location, and for providing said deactivation signal after said deactivation sensor senses the presence of the leading edge of said forwardmost coupon.

* * * * *